US011139608B2

(12) United States Patent
Tanikawa

(10) Patent No.: US 11,139,608 B2
(45) Date of Patent: Oct. 5, 2021

(54) CONNECTOR

(71) Applicant: Sumitomo Wiring Systems, Ltd., Yokkaichi (JP)

(72) Inventor: Naotaka Tanikawa, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/999,002

(22) Filed: Aug. 20, 2020

(65) Prior Publication Data

US 2021/0066843 A1 Mar. 4, 2021

(30) Foreign Application Priority Data

Aug. 28, 2019 (JP) ..... JP2019-155609

(51) Int. Cl.
*H01R 13/506* (2006.01)
*H01R 13/516* (2006.01)

(52) U.S. Cl.
CPC ..... *H01R 13/506* (2013.01); *H01R 13/516* (2013.01)

(58) Field of Classification Search
CPC ..... H01R 13/56; H01R 13/5812; H01R 13/5825; H01R 13/5804; H01R 13/516; H01R 13/50
See application file for complete search history.

(56) References Cited

U.S. PATENT DOCUMENTS

| | | | | |
|---|---|---|---|---|
| 6,540,547 | B2 | 4/2003 | Zweigle | |
| 7,384,312 | B2 * | 6/2008 | Van Der Mee .. | H01R 13/62911 439/607.44 |
| 7,476,121 | B2 * | 1/2009 | Tsuji ..... | H01R 13/4223 439/465 |
| 10,063,007 | B2 * | 8/2018 | Sugimoto ..... | H01R 13/5812 |
| 2011/0021064 | A1 | 1/2011 | Shibata et al. | |
| 2014/0080351 | A1 * | 3/2014 | Kawakami ..... | H01R 13/5804 439/464 |

FOREIGN PATENT DOCUMENTS

| | | |
|---|---|---|
| JP | 3083747 | 11/2001 |
| JP | 2007-200696 | 8/2007 |
| JP | 2017-73300 | 4/2017 |

* cited by examiner

*Primary Examiner* — Briggitte R. Hammond
(74) *Attorney, Agent, or Firm* — Gerald E. Hespos; Michael J. Porco; Matthew T. Hespos

(57) ABSTRACT

A connector is provided with a body cover and a lid cover for covering a wire. A tightening member is to be wound along a surface of the body cover. A first part and a second part are provided on the surface of the body cover while being spaced apart in a circumferential direction. A recess is provided between the first and second parts in the body cover, and a pressing portion is stretched from the first part toward the second part in the tightening member. A coupling is to be received into the recess in the lid cover, and a pressed portion is arranged outwardly of a virtual straight line connecting the first and second parts in the coupling. The pressing portion presses the pressed portion toward an inner surface of the recess.

4 Claims, 9 Drawing Sheets

CONNECTOR

BACKGROUND

Field of the Invention

This disclosure relates to a connector.

Related Art

Japanese Utility Model Registration No. 3083747 discloses a connector including a casing, a cover to be mounted on the casing and a tightening member (i. e. a tightening belt) provided on the cover side. Wires (e. g. a wiring harness) are arranged on the upper surface of the casing member. The tightening member is wound on one side surface of the cover, the upper surfaces of the wires, the other side surface of the cover and the lower surface of the casing. The wires are fixed between an upper part of the tightening member and the casing. A connector with a cover and a tightening member of this type also is disclosed in Japanese Unexamined Patent Publication No. 2007-200696 and Japanese Unexamined Patent Publication No. 2017-73300.

The casing of Japanese Utility Model Registration No. 3083747 is sandwiched between a lower part of the tightening member and the wires, and the wires are movable inside the upper part of the tightening member. Thus, it is difficult to form a state where the tightening member presses casing toward the wires. As a result, there is a concern that a clearance is formed between the lower part of the tightening member and the casing and may permit positions of the casing and the cover to deviate.

Accordingly, it is aimed to provide a connector in which a positional deviation of a cover can be prevented by a tightening member.

SUMMARY

This disclosure is directed to a connector that has a connector housing and a wire that is pulled out from the connector housing. A body cover and a lid cover are provided to cover the wire, and a tightening member is to be wound along a surface of the body cover. A surface of the body cover has first and second parts that are spaced apart in a circumferential direction, and a recess is between the first and second parts of the body cover. A pressing portion is stretched from the first part toward the second part in the tightening member. A coupling is to be received into the recess in the lid cover, and a pressed portion is arranged outward of a virtual straight line connecting the first and second parts in the coupling. The pressing portion presses the pressed portion toward an inner surface of the recess.

According to this configuration, the tightening member is wound along the surface of the body cover. The pressing portion of the tightening member is stretched from the first part toward the second part. In this way, the pressed portion of the coupling is pressed toward the inner surface of the recess. The pressed portion of the coupling is arranged outward of the virtual straight line connecting the first and second parts. Thus, the coupling is pressed strongly toward the inner surface of the recess. As a result, a positional deviation of the coupling with respect to the inner surface of the recess is less likely to occur and, eventually, positional deviations of the body cover and the lid cover can be prevented.

The first part may be at a position higher than the pressed portion, and the pressing portion is arranged obliquely downward from the first part to the pressed portion when the first part is facing upward. According to this configuration, the pressing portion of the tightening member presses the pressed portion of the coupling is pressed more strongly toward the inner surface of the recess. Thus, reliability in preventing the positional deviations of the body cover and the lid cover is enhanced.

The recess may have a supporting surface for supporting the coupling, a receiving surface facing one side surface of the coupling and an inner corner located at an intersecting part of the supporting surface and the receiving surface. The pressed portion may be arranged at a position diagonal to the inner corner. According to this configuration, the pressed portion of the coupling is pressed toward the inner corner part of the recess by the pressing portion of the tightening member. Thus, reliability in preventing the positional deviations of the body cover and the lid cover can be enhanced.

The surface of the body cover may include a third part and a fourth part that are spaced apart in the circumferential direction. The body cover may include a wire-side recess for receiving the wire between the third and fourth parts. The tightening member may include a wire fixing portion stretched from the first part to the fourth part. The wire fixing portion presses the wire toward an inner surface of the wire-side recess. According to this configuration, the surface of the body cover is utilized as an area for receiving the coupling and the wire, thereby contributing to a size reduction of the body cover.

DETAILED DESCRIPTION

An example of the connector of the present disclosure is described below with reference to the drawings. Note that the invention is not limited to these illustrations and include all changes in the scope of claims and in the meaning and scope of equivalents.

Figure 1:
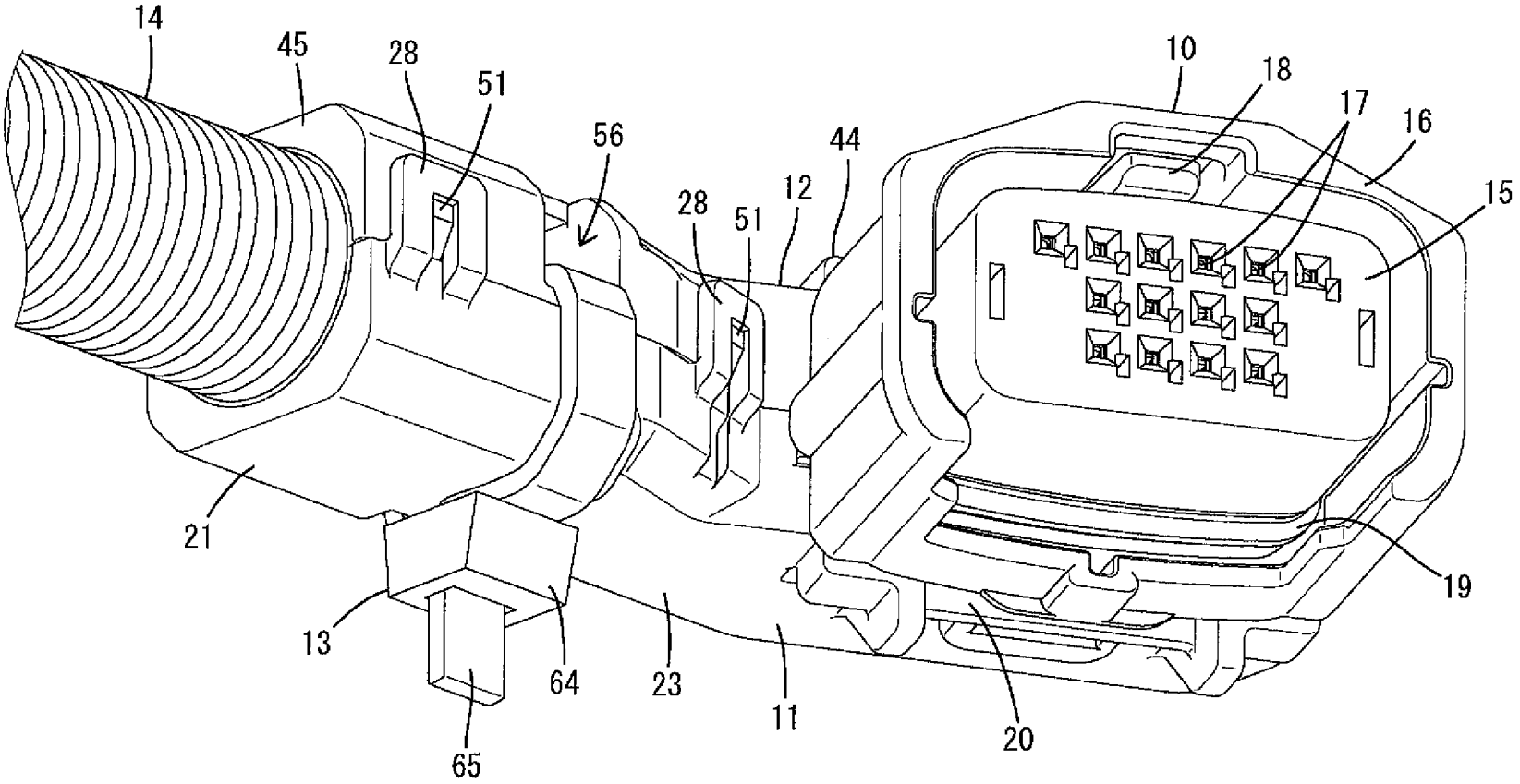
FIG. 1 is a perspective view of a connector according to an embodiment viewed obliquely from below.
Figure 2:
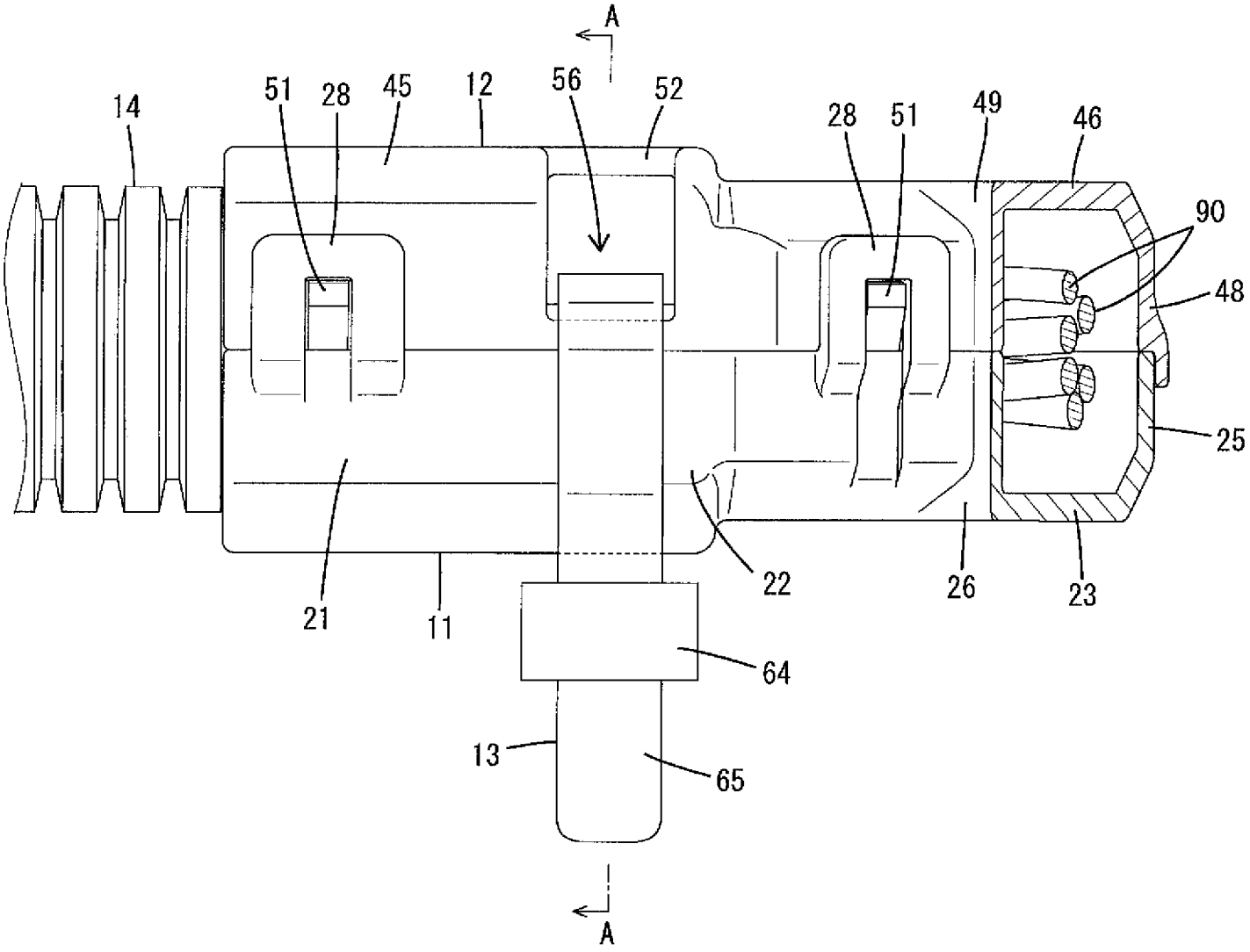
FIG. 2 is a side view of a part fastened by a tightening member with a body cover and a lid cover united.
Figure 3:
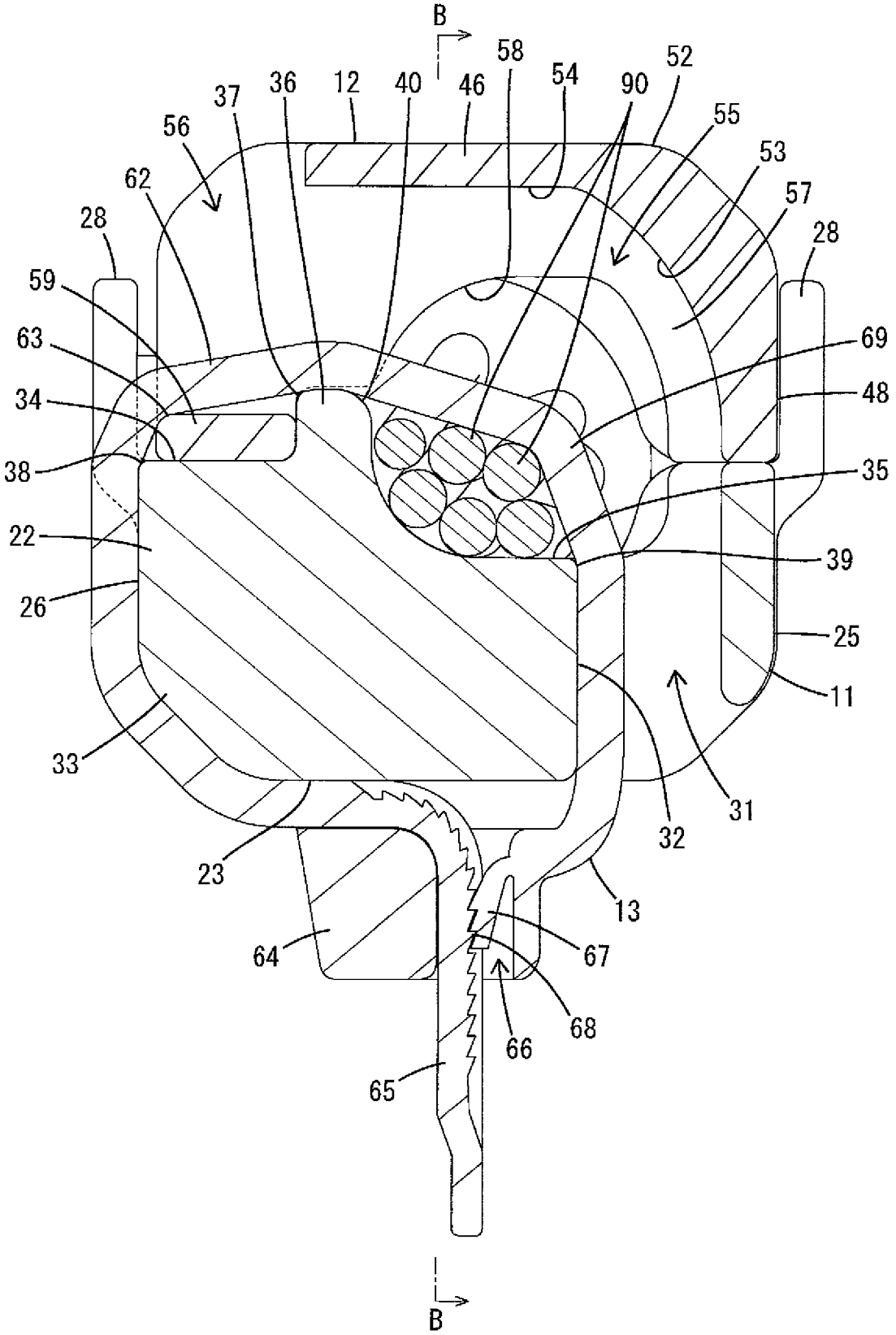
FIG. 3 is a section along A-A of FIG. 2.
Figure 4:
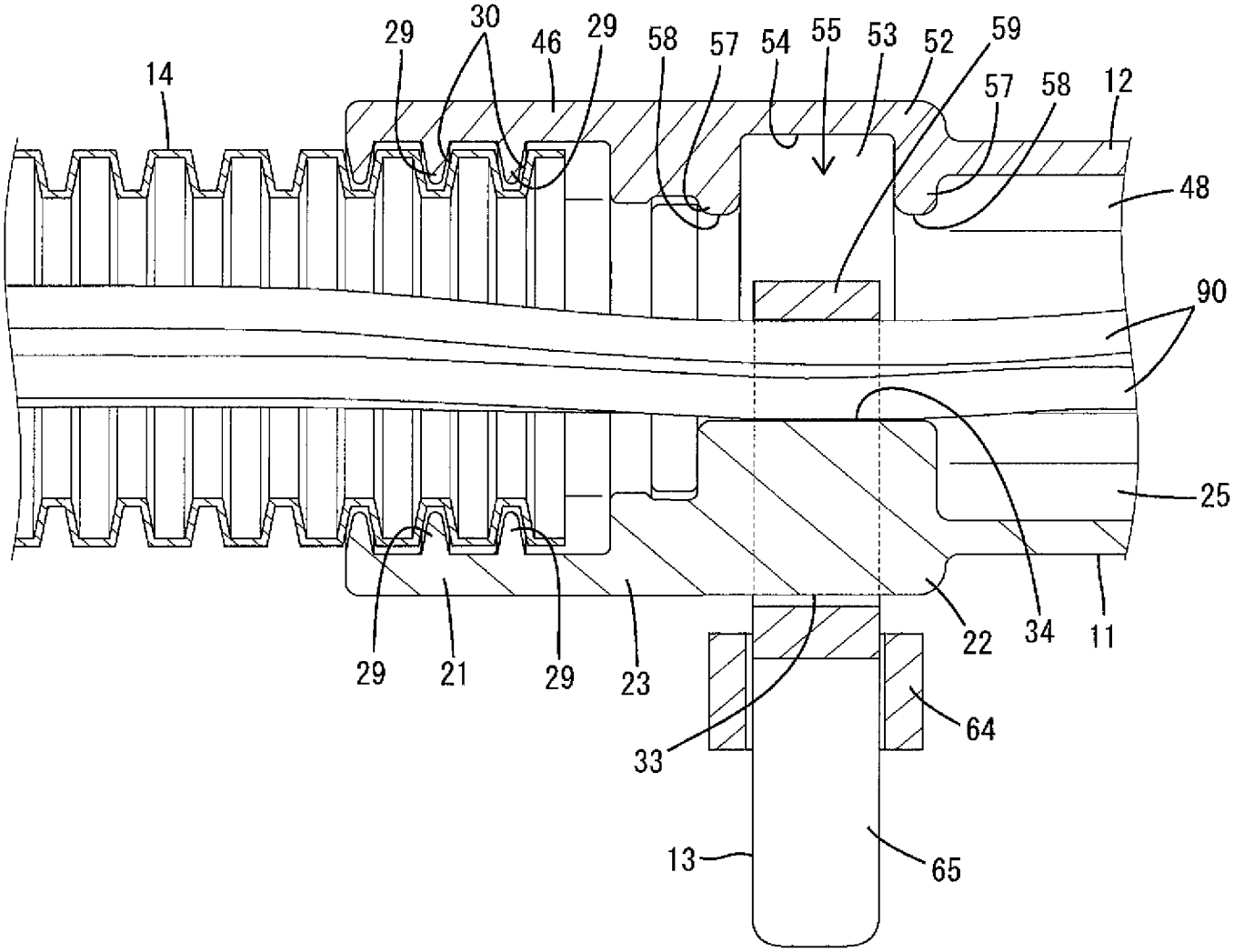
FIG. 4 is a section along B-B of FIG. 3.

As shown in FIG. 1, a connector includes a connector housing 10, a body cover 11, a lid cover 12, a tightening member 13 and a corrugated tube 14. The body cover 11 and the lid cover 12 are united with each other and form a tubular shape. In the following description, the body cover 11 and the lid cover 12 in a united state is called a cover member. As shown in FIGS. 2 to 4, wires 90 are inserted inside the cover member. The tightening member 13 is constituted by a tie band.

<Connector Housing 10>

The connector housing 10 is made of synthetic resin and includes, as shown in FIG. 1, a block-like housing body 15 and a fitting tube 16 surrounding the outer periphery of the housing body 15. The housing body 15 includes cavities 17. An unillustrated terminal fitting is inserted into each cavity 17. Each terminal fitting is connected to an end of the wire 90. The wires 90 are pulled out from the respective cavities 17 of the housing body 15.

A deflectable and deformable lock arm 18 projects on the upper surface (surface on an upper side of FIG. 1) of the housing body 15. The lock arm 18 locks an unillustrated mating connector housing when the connector housing 10 is connected to the mating connector housing. In this way, the connector housings are held in a connected state. Although not shown, the mating connector housing includes a receptacle to be inserted between the housing body 15 and the fitting tube 16.

A seal ring 19 is mounted on the outer peripheral surface of the housing body 15. The seal ring 19 is made of rubber, such as silicon rubber, and is sandwiched between the connector housings to seal the connector housings are sealed in a liquid-tightly manner.

<Body Cover 11>

The body cover 11 is arranged on a lower side (lower side of FIGS. 1 to 4) in the cover member. The body cover 11 is made of synthetic resin and includes, as shown in FIG. 1, a housing mounting portion 20 for receiving a lower part of the connector housing 10 and a tube mounting portion 21 for receiving a lower part of the corrugated tube 14 on an exit side where the wire 90 are drawn out. An end where the housing mounting portion 20 is located is a front (right side of FIG. 1) and an end where the tube mounting portion 21 is located (left side of FIG. 1) is a rear. Thus, the body cover 11 extends in a front-rear direction from the housing mounting portion 20 to the tube mounting portion 21.

Figure 5:
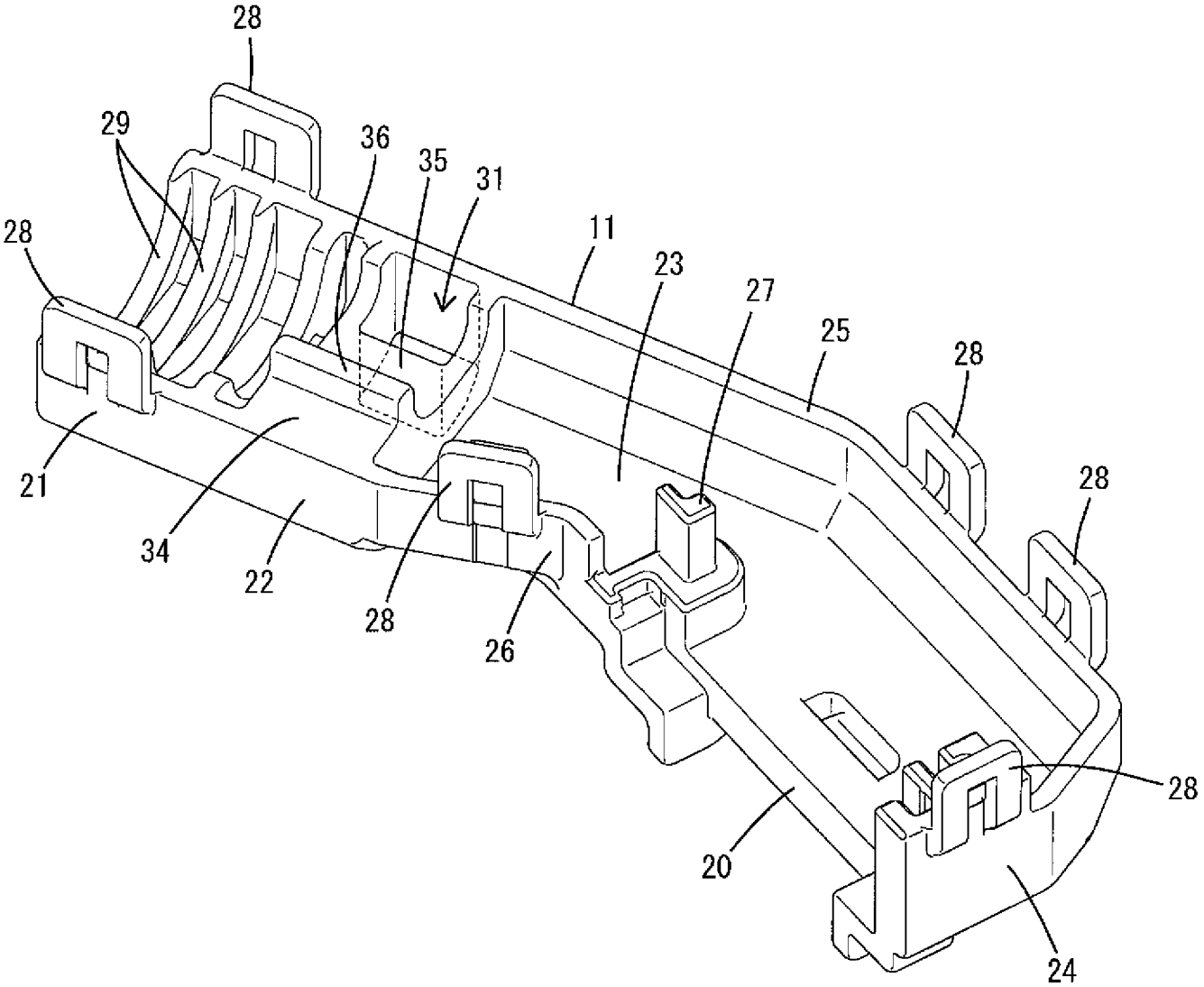
FIG. 5 is a perspective view of the body cover viewed obliquely from above.
Figure 6:
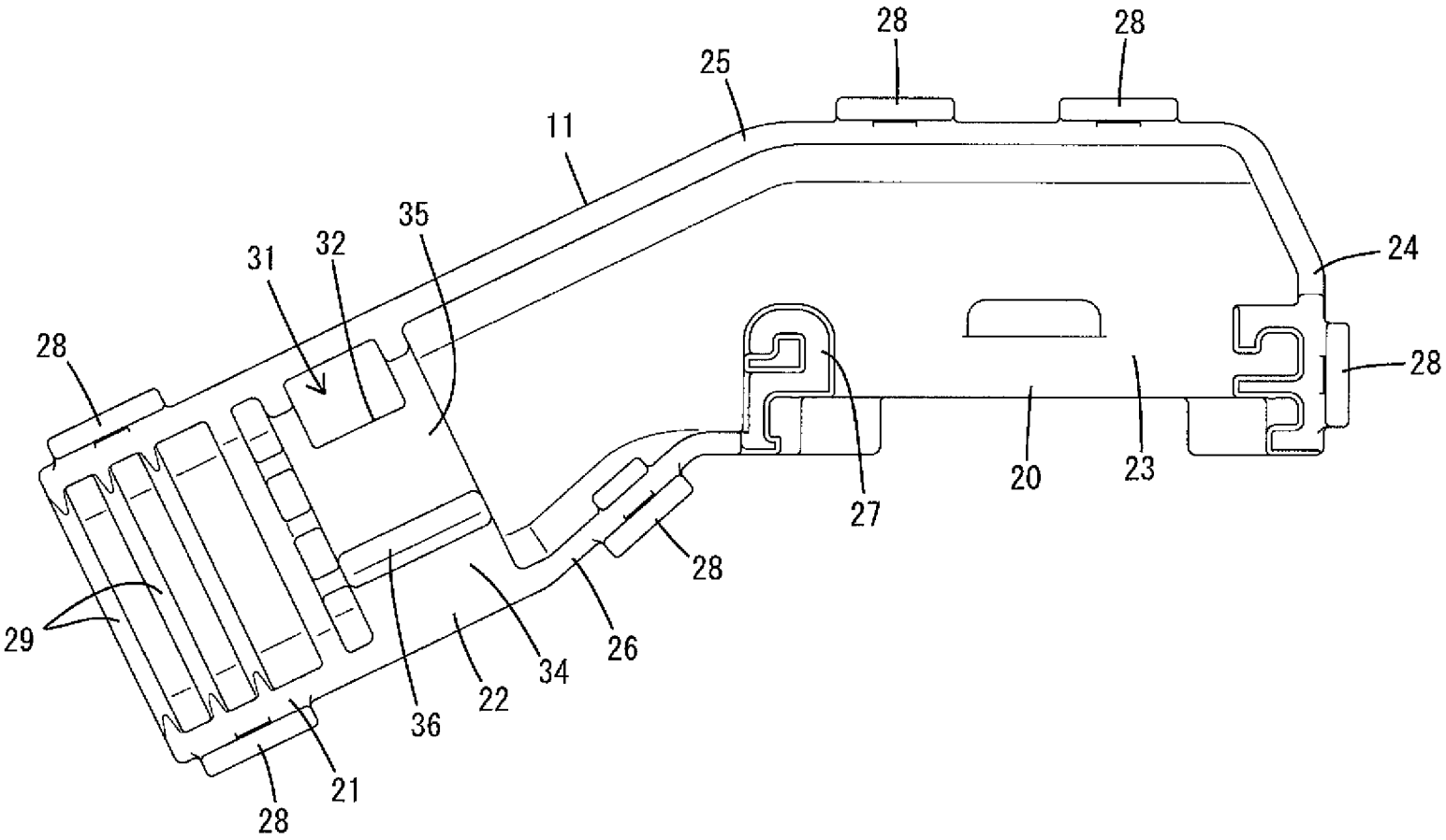
FIG. 6 is a plan view of the body cover.

As shown in FIGS. 5 and 6, the body cover 11 includes a bent part intersecting the front-rear direction at an intermediate position in the front-rear direction and near the housing mounting portion 20. The housing mounting portion 20 is farther on one side (right side of FIG. 6) than the tube mounting portion 21 via the bent part. A fastened portion 22 is between the bent part and the tube mounting portion 21 at a position adjacent to the tube mounting portion 21, and the tightening member 13 is wound on the fastened portion 22.

The body cover 11 has a bottom wall 23 extending over the entire length in the front-rear direction. A front wall 24 rises from the front end of the bottom wall 23, a first side wall 25 rises from a first side end of the bottom wall 23 and a second side wall 26 rises from the second side of the bottom wall 23. To receive the lower part of the connector housing 10, the body cover 11 does not have the second side wall 26 on the side of the housing mounting portion 20.

The body cover 11 includes a column 27 rising from the bottom wall 23 and connected to the other side wall 26 in the bent part. The column 27 has a curved outer surface on a base end connected to the bottom wall 23. The respective wires 90 are bent toward the fastened portion 22 along the outer surface of the column 27 after being pulled out from the connector housing 10.

The body cover 11 includes spaced apart body locks 28 on the front wall 24, the first side wall 25 and the second side wall 26. The body locks 28 are in the form of rectangular frames projecting upward. The body locks 28 include one on the front wall 24 of the housing mounting portion 20, two on the first side wall 25 of the housing mounting portion 20, one on each of the first and second side walls 25 and 26 of the tube mounting portion 21 and one on the second side wall 26 between the housing mounting portion 20 and the fastened portion 22.

The tube mounting portion 21 includes ridges 29 arranged in the front-rear direction on an inner surface. The ridges 29 have semicircular cross-sectional shapes and are fit into grooves 30 of the corrugated tube 14, as shown in FIG. 4.

As shown in FIG. 3, the fastened portion 22 includes a thick padded part (hatched part of FIG. 3) on an inner side. The padded part is integrated with the second side wall 26. The fastened portion 22 includes an insertion hole 31 between the padded part and the first side wall 25. The insertion hole 31 penetrates through the bottom wall 23 in a vertical direction. The padded part has a creepage surface 32 extending along the vertical direction on a surface facing the insertion hole 31. The tightening member 13 is inserted through the insertion hole 31 and arranged along the creepage surface 32.

The fastened portion 22 includes a surface 33 extending along a circumferential direction. The surface 33 includes the creepage surface 32, the upper surface of the padded part, the outer surface of the other side wall 26 and the lower surface of the bottom wall 23. The surface 33 goes around the outer periphery of the padded part. The tightening member 13 is wound along the surface 33.

The fastened portion 22 includes a recess 34 and a wire-side recess 35 on the upper surface of the padded part. The recess 34 is provided near the second side wall 26 on the upper surface of the padded part. The wire-side recess 35 is provided near the first side wall 25 on the upper surface of the padded part. The fastened portion 22 includes a partition 36 partitioning between the recess 34 and the wire-side recess 35. The partition 36 is a rib extending in the front-rear direction on the upper surface of the padded part. The upper surface of the partition 36 is facing the inside of the lid cover 12 in the cover member.

The upper surface of the partition 36 includes a first part 37 on a corner on the second side facing the recess 34 and a fourth part 40 on a corner on first side facing the wire-side recess 35. The first and fourth parts 37, 40 are curved surfaces with a radius of curvature of the first part 37 being smaller than that of the fourth part 40.

The wire-side recess 35 is recessed deeper than the recess 34. The wire-side recess 35 has a curved cross-sectional shape and is open on upper side and one lateral sides. The body cover 11 includes a third part 39 at an intersection of one side of the wire-side recess 35 and the creepage surface 32 in the padded part. The third part 39 has a cross-sectional shape arcuate or projecting at a right angle. The respective wires 90 are inserted into the wire-side recess 35.

Figure 9:
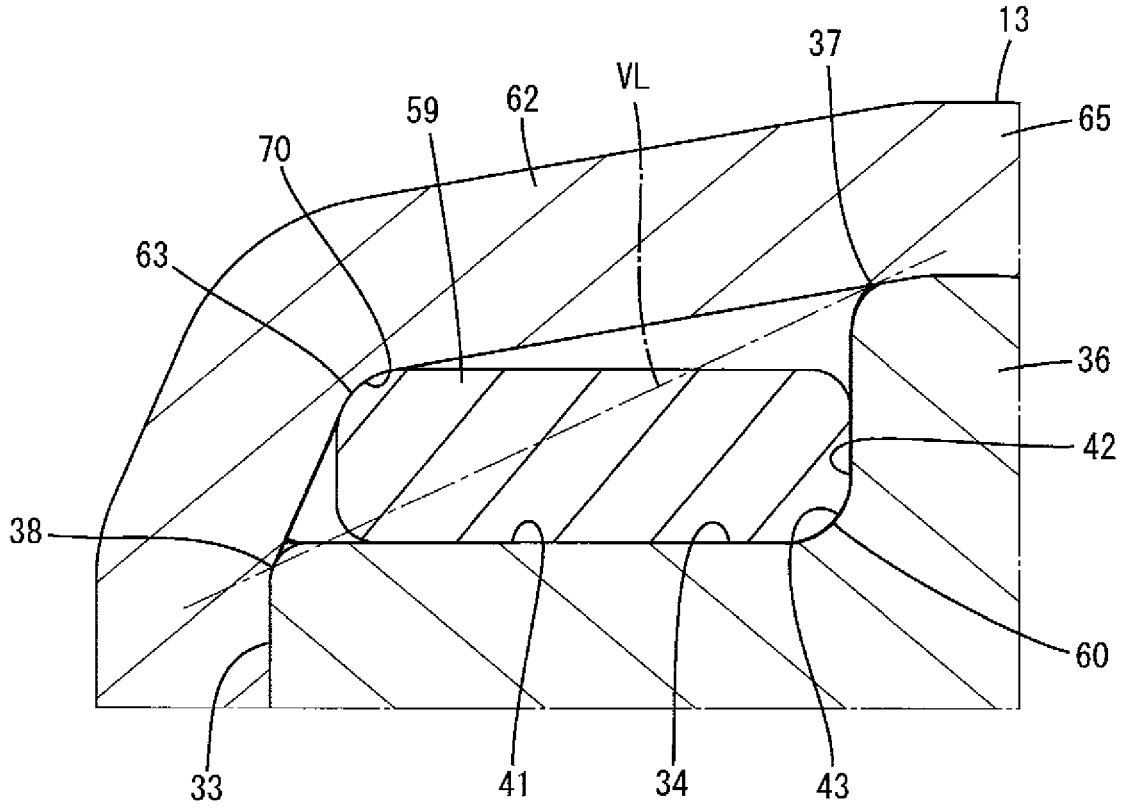
FIG. 9 is an enlarged section showing a state where a pressing portion is received in a recess and pressed toward an inner surface of the recess by the tightening member.

The recess 34 has an L-shaped cross-section and is open on upper and the second lateral sides. As shown in FIG. 9, the recess 34 has, on an inner surface, a supporting surface 41 extending along a lateral direction of FIG. 9, a receiving surface 42 extending along the vertical direction and an inner corner 43 at an intersection of the supporting surface 41 and the receiving surface 42. The inner corner 43 has an arcuate or right-angle shape. The body cover 11 includes a second part 38 at an intersection of the supporting surface 41 of the recess 34 and the outer surface of the second side wall 26. The second part 38 has a cross-sectional shape arcuate or projecting at a right angle, similar to the third part 39. As described above, the first to fourth parts 37 to 40 are provided on the surface 33 of the fastened portion 22 while being spaced apart in the circumferential direction.

<Lid Cover 12>

The lid cover 12 is on an upper side of the cover member in FIGS. 1 to 4. The lid cover 12 is made of synthetic resin and includes a housing covering portion 44 for receiving an upper part of the connector housing 10 and a tube covering portion 45 for receiving an upper part of the corrugated tube 14 on the exit side where the wires 90 are drawn out.

Figure 7:
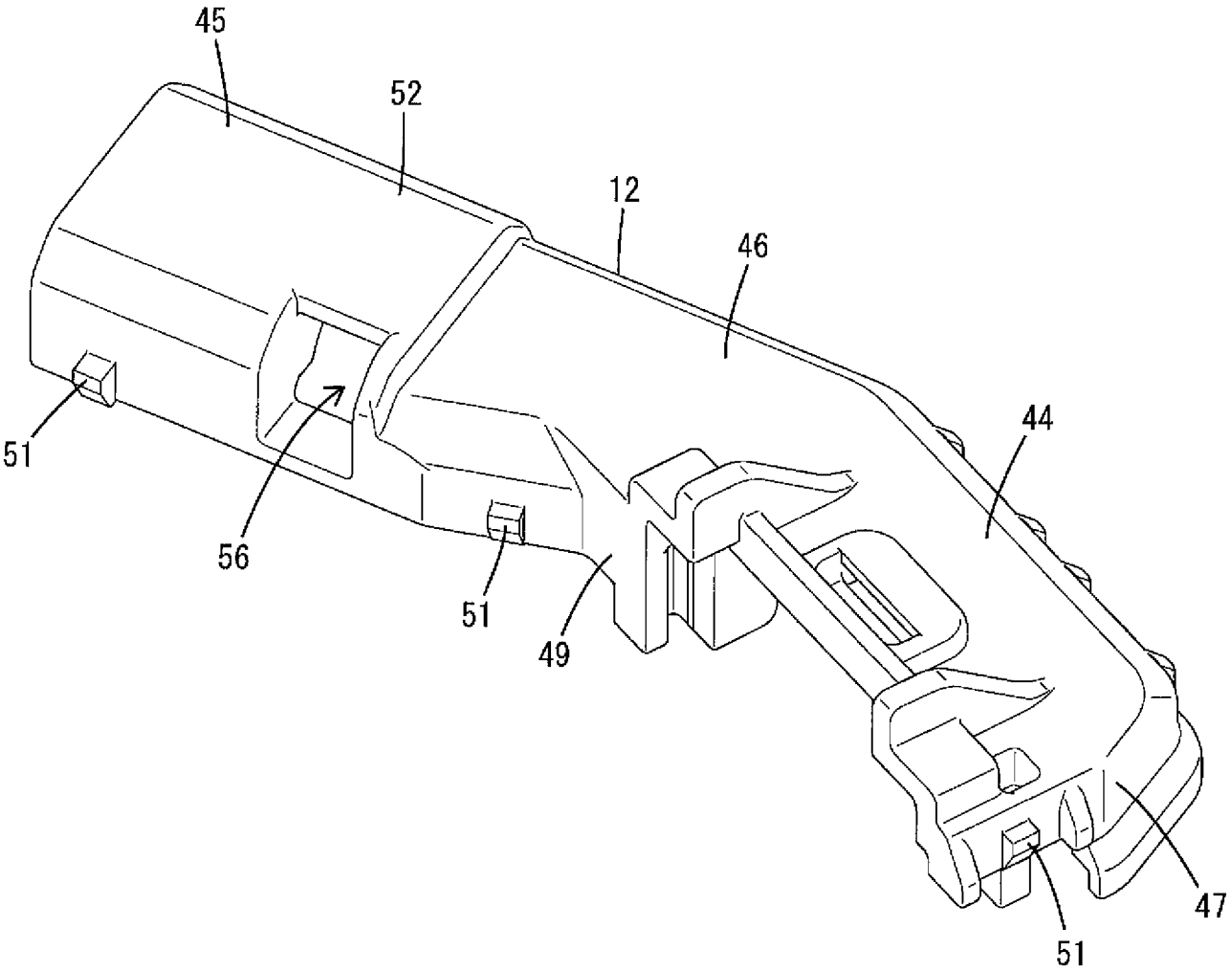
FIG. 7 is a perspective view of the lid cover viewed obliquely from above.
Figure 8:
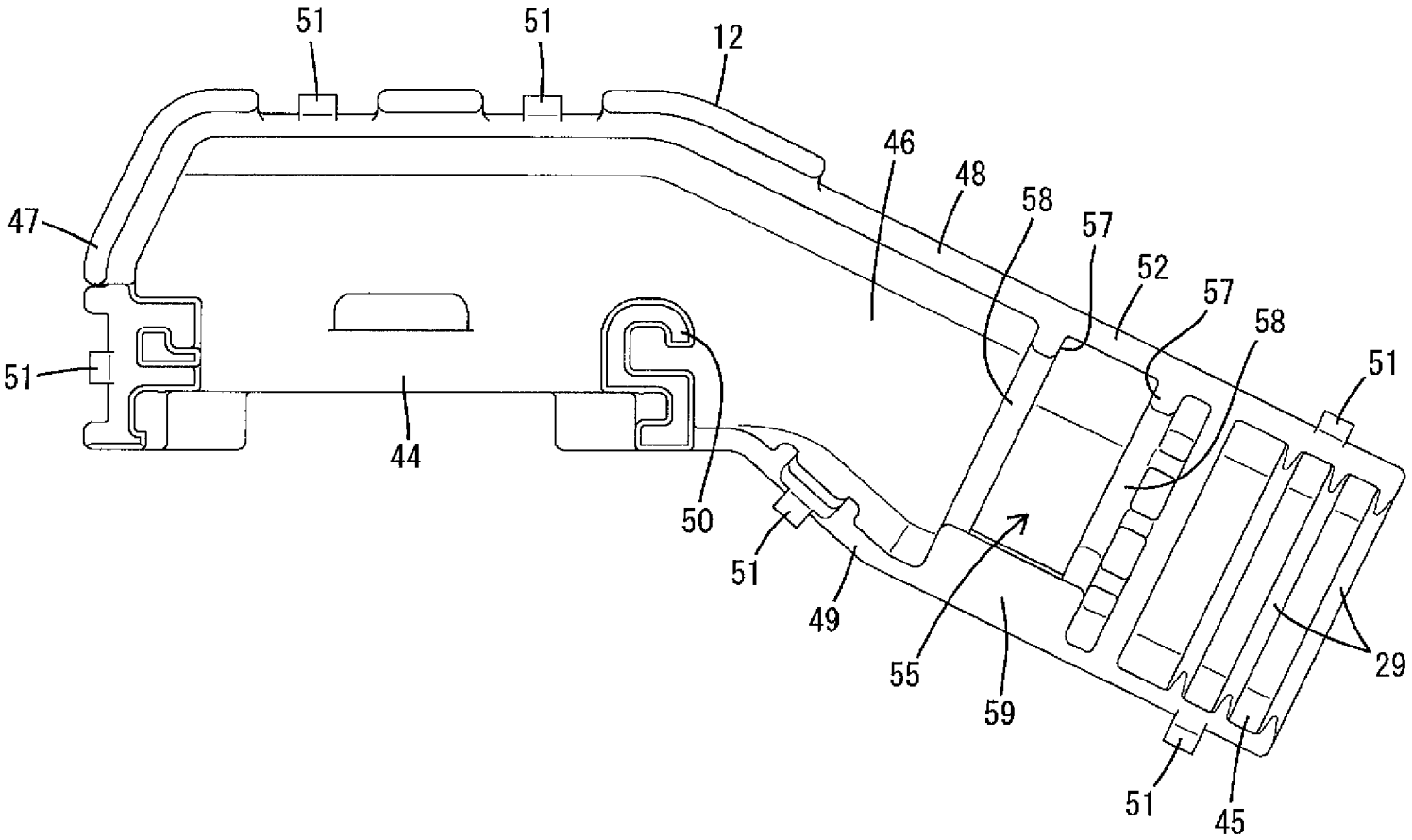
FIG. 8 is a bottom view of the lid cover.

As shown in FIGS. 7 and 8, the lid cover 12 extends long in the front-rear direction from the housing covering portion 44 to the tube covering portion 45. The lid cover 12 is shaped similar to the body cover 11 and includes a bent part at an intermediate position in the front-rear direction.

The lid cover 12 includes a ceiling wall 46 extending over the entire length in the front-rear direction. The lid cover 12 has a front end 47 projecting down from the front end of the ceiling wall 46, a first side wall 48 projecting down from the first side end of the ceiling wall 46 and a second side end wall 49 projecting down from the second side of the ceiling wall 46. To receive the upper part of the connector housing 10, the lid cover 12 does not have the second side wall 49 on the side of the housing covering portion 44.

As shown in FIG. 8, the lid cover 12 includes a positioning projection 50 projecting down from the ceiling wall 46 and connected to the second side wall 49 in the bent part. The positioning projection 50 is positioned and fit to the column 27 in the cover member.

The lid cover 12 includes spaced apart lid locks 51 on the front wall 47, the first side wall 48 and the second side wall 49. The lid locks 51 are claw-like and provided at positions corresponding to the respective body locks 28.

Similar to the tube mounting portion 21, the tube covering portion 45 includes ridges 29 to be fit into the respective grooves 30 of the corrugated tube 14.

The lid cover 12 includes an engaging portion 52 at a position facing the fastened portion 22 (position adjacent to the tube covering 45) in the cover. As shown in FIG. 3, the engaging portion 52 has a guide surface 53 arcuately continuous from the inner side surface of the first end wall 48 to the inner lower surface of the ceiling wall 46. The guide surface 53 of the engaging portion 52 faces the insertion hole 31 from above in the cover. The engaging portion 52 has a straight surface 54 extending along the width direction (lateral direction of FIG. 3) on the inner surface of the ceiling wall 46. A start end (right end of FIG. 3) of the straight surface 54 is connected to the upper end of the guide surface 53.

The engaging portion 52 has an insertion space 55, through which the tightening member 13 is inserted, inside. The insertion space 55 is defined by the guide surface 53 and the straight surface 54 of the engaging portion 52. The tightening member 13 is bent from the guide surface 53 to the straight surface 54 in the insertion space 55.

An opening 56 penetrates the engaging portion 52 in an in-out direction from a final end (left end of FIG. 3) of the straight surface 54 to a lower end part of the second side wall 49. The opening 56 is rectangular in a side view and a plan view. The tightening member 13 can be seen through the opening 56 from outside (upper and lateral sides).

As shown in FIGS. 4 and 8, two projecting pieces 57 are spaced apart in the front-rear direction on an inner surface of the engaging portion 52. Each projecting piece 57 includes a curved recess 58 on a lower end (tip in a projecting direction). As shown in FIG. 3, the recess 58 of each projecting piece 57 is above the wire-side recess 35 and continuous with the wire-side recess 35. The wires 90 are inserted between the recesses 58 and the wire-side recess 35. Note that the recesses 58 and the wire-side recess 35 are arranged on one widthwise side of the first end wall 48 and the first side wall 25 in the cover member.

A coupling 59 is on a lower part of the second end wall 49 of the engaging portion 52 and closes a lower part of the opening 56. As shown in FIG. 8, the lower surface of the coupling 59 is continuous with lower surfaces of parts of the other side end wall 49 adjacent in the front-rear direction without any step. The coupling 59 protrudes in toward the insertion space 55, thereby being thicker than the parts of the second end wall 49 adjacent in the front-rear direction. Front and rear ends of the coupling 59 are connected integrally to parts of the lower ends of the respective projecting pieces 57 adjacent to the recesses 58.

As shown in FIG. 3, the coupling 59 has a rectangular cross-sectional shape (transverse cross-sectional shape) long along the width direction (lateral direction of FIG. 3) and has four rounded corners. The coupling 59 is received into the recess 34.

Upper and lower surfaces of the coupling 59 are arranged along the lateral direction. The left and right surfaces (outer and inner end surfaces) of the coupling 59 are arranged along the vertical direction. Four corner surfaces of the coupling 59 are rounded.

As shown in FIG. 9, the upper surface of the coupling 59 is below the upper surface of the partition 36 in the cover member. The lower surface of the coupling 59 is supported entirely in contact with the supporting surface 41 of the recess 34 in the cover member. The inner end surface of the coupling 59 is received entirely in contact with the receiving surface 42 of the recess 34 in the cover member. A rounded corner 60 on a lower-inner side faces along the inner corner 43 of the recess 34, and a rounded corner on an upper-outer side is configured as a pressed portion 63 to be pressed by a later-described pressing portion 62 of the tightening member 13. The pressed portion 63 is at a position facing the round corner 60 on the lower-inner side.

<Fastening Member 13>

The tightening member 13 is made of synthetic resin and includes, as shown in FIGS. 1 to 3, a base 64 in the form of a rectangular block and a strip-like band 65 extending from the base 64. The base 64 is placed on the lower surface of the bottom wall 23 on the surface 33 of the body cover 11. As shown in FIG. 3, a locking hole 66 penetrates the base 64 in the vertical direction in a state placed on the lower surface of the bottom wall 23. A locking projection 67 projects from the inner surface of the locking hole 66 in the base 64.

The band 65 extends from one side surface of the upper end of the base 64 with the base 64 placed on the lower surface of the bottom wall 23. The band 65 is bent along the surface 33 of the fastened portion 22. Specifically, as shown in FIG. 3, the band 65 can be bent from the base 64 and successively contact the creepage surface 32, the third part 39, the fourth part 40, the first part 37, the second part 38, the outer surface of the other side wall 26 and the lower surface of the bottom wall 23. A tip of the band 65 is inserted into the locking hole 66 of the base 64 from above. The band 65 includes sawtooth-like locking teeth 66 on an inner side surface of bending. The locking teeth 68 of the band 65 mesh with the locking projection 67 in the locking hole 66. In this way, the band 65 maintains an annular fastening state in contact with the surface 33 of the fastened portion 22.

The band 65 includes a wire fixing portion 69 stretched from the third part 39 toward the fourth part 40 in the fastening state. The wire fixing portion 69 includes a part bent from the side of the base 64 of the band 65 toward the other side with the third part 39 as a starting point and inclined toward the other side from that bent position to a position in contact with the outer peripheries of the wires 90. Further, the wire fixing portion 69 includes a part inclined at a steeper angle toward the other side from the position in contact with the outer peripheries of the wires 90 to the fourth part 40. The wires 90 in contact with the wire fixing portion 69 are arranged on an outermost side in the wire-side recess 35.

The band 65 includes the pressing portion 62 stretched from the first part 37 toward the second part 38 in the fastening state. The pressing portion 62 has a part bent down from the upper surface side of the partition 36 with the first part 37 as a starting point and inclines down from that bent position to a position in contact with the pressed portion 63 of the coupling 59. Further, the pressing portion 62 includes a part inclined down at a steeper angle from the position in contact with the pressed portion 63 of the coupling 59 to the second part 38. Note that the formation positions and ranges of the wire fixing portion 69 and the pressing portion 62 in the band 65 are changed depending on the fastening state.

<Corrugated Tube 14>

The corrugated tube 14 is made of synthetic resin and is in the form of a circular pipe. As shown in FIG. 4, the corrugated tube 14 includes grooves 30 arranged side by side in the front-rear direction. Fitting the ridges 29 into the respective grooves 30 restricts a positional deviation of the corrugated tube 14 with respect to the cover member in the front-rear direction. A radial center of the corrugated tube 14 is at a radial center of a rear part of the cover member. The respective wires 90 are inserted in the corrugated tube 14.

<Fastening (Coupling) Structure of Cover Member>

In assembling, the body cover 11 and the lid cover 12 are united vertically so that the upper end of the body cover 11 (upper ends of the one side wall 25 and the other side wall 26) and the lower end of the lid cover 12 (lower ends of the first end wall 48 and the second end wall 49) are in contact with each other (see FIGS. 1 to 3). The connector housing 10 is sandwiched and held between the housing mounting portion 20 of the body cover 11 and the housing covering 44 of the lid cover 12. Further, the corrugated tube 14 is sandwiched and held between the tube mounting portion 21 of the body cover 11 and the tube covering portion 45 of the lid cover 12. After the respective body locks 28 are deflected and deformed, the lid locks 51 are fit into the respective body locks 28. Locking the body locks 28 and the respective lid locks 51 holds the body cover 11 and the lid cover 12 in the united state as the cover member.

The wires 90 from the connector housing 10 are bent in the bent part (at the column 27) in the cover member and drawn out to outside by way of the corrugated tube 14. The wires 90 are inserted between the wire-side recess 35 of the body cover 11 and the recesses 58 of the lid cover 12 in the cover member. The coupling 59 of the lid cover 12 is placed on the supporting surface 41 of the recess 34 of the body cover 11.

Subsequently, the band 65 of the tightening member 13 is inserted into the insertion hole 31 of the body cover 11 from below (see FIG. 3). The tip of the band 65 enters the insertion space 55 of the engaging portion 52 after coming out from the insertion hole 31 of the fastened portion 22. The tip of the band 65 contacts the guide surface 53 in the recesses 58 and is bent smoothly along the straight surface 54 from the guide surface 53. Then, the tip of the band 65 faces the opening 56. Accordingly, a worker grips the tip of the band 65 through the opening 56 and places the tip of the band 65 from the outer surface of the second side wall 26 to the lower surface of the bottom wall 23 in the surface 33. The tip of the band 65 is inserted from above into the locking hole 66 of the base 64 below the bottom wall 23. The worker grips the tip of the band 65 coming out from the locking hole 66 and pulls the tip part down. In this way, the locking teeth 68 of the band 65 are locked to the locking projection 67 in the locking hole 66 with the band 65 held in close contact with the surface 33 in the circumferential direction.

The wire fixing portion 69 of the band 65 is extends between the third part 39 and the fourth part 40 while pressing the respective wires 90 against the curved inner surface of the wire-side recess 35 (see FIG. 3). The wire fixing portion 69 is in contact with the outer peripheries of the wires 90 most distant from the inner back of the inner surface of the wire-side recess 35. Thus, the wire fixing portion 69 apply a pressing force to the wires 90 toward the inner back of the wire-side recess 35. The wires 90 are fixed to the wire-side recess 35 by receiving the pressing force of the wire fixing portion 69.

The pressing portion 62 of the band 65 extends between the first and second parts 37, 38 while pressing the coupling 59 against the inner surface of the recess 34 (see FIGS. 3 and 9). The pressing portion 62 is in contact with the pressed portion 63 at a position diagonal to the inner corner 43 of the recess 34 in the coupling 59 (see FIG. 9).

Specifically, the pressing portion 62 is inclined down from the first part 37 to the pressed portion 63 and is inclined down at a steeper angle from the pressed portion 63 to the second part 38 with a part in contact with the pressed portion 63 serving as a top part 70. In other words, the pressed portion 63 of the coupling 59 and the top 70 of the pressing portion 62 are outward of a virtual straight line (dashed-dotted line VL of FIG. 9) linearly connecting the first and second parts 37, 38. Thus, the pressing portion 62 can apply a pressing force to the coupling 59 toward the inner corner 43 of the recess 43. The coupling 59 is fixed to the recess 34 by receiving the pressing force of the pressing portion 62. This stable fixing of the coupling 59 to the recess 34 restricts a positional deviation of the lid cover 12 with respect to the body cover 11. As a result, an insertion area for the wires 90 in the cover member is specified, and the contact of the respective wires 90 with the inner surface of the corrugated tube 14 can be prevented. Damage of the wires 90 and the corrugated tube 14 is prevented by arranging the wires 90 away from the inner surface of the corrugated tube 14.

As described above, the pressed portion 63 of the coupling 59 is arranged outward of the virtual straight line VL. Thus, a state where the coupling 59 is pressed strongly toward the inner surface of the recess 34 can be realized. As a result, a positional deviation of the coupling 59 with respect to the inner surface side of the recess 34 is less likely and, eventually, mutual positional deviations of the body cover 11 and the lid cover 12 are prevented.

The first part 37 is provided on the upper surface of the partition 36 and at a position higher than the pressed portion 63. The pressing portion 62 is arranged obliquely downward from the first part 37 to the pressed portion 63. Thus, the coupling 59 is pressed more strongly toward the inner corner 43 of the recess 34. As a result, reliability in preventing positional deviations of the body cover 11 and the lid cover 12 can be enhanced.

Further, the surface 33 includes the recess 34 and the wire-side recess 35 via the partition portion 36. The coupling 59 is received into the recess 34. The wires 90 are received into the wire-side recess 35. In that state, the tightening member 13 is fastened to the fastened portion 22 so that the coupling 59 and the respective wires 90 are fixed to the fastened portion 22. In this way, the surface 33 is utilized as an area for receiving the coupling 59 and the wires 90, thereby contributing to a size reduction of the body cover 11.

The embodiment disclosed this time should be considered to be illustrative rather than restrictive in all aspects.

Although the recess has an L-shaped cross-section in the case of the above embodiment, a recess may have a U-shaped cross-section or a curved cross-section like the wire-side recess as another embodiment.

Although the wire-side recess is provided in the surface in the case of the above embodiment, a wire-side recess may be provided in a part other than the surface as another embodiment. Further, the wire-side recess may not be provided.

Although the tightening member and the body cover are provided separately in the case of the above embodiment, a tightening member and a body cover may be integral as another embodiment.

Although the body cover and the lid cover are provided separately in the above embodiment, a body cover and a lid cover may be integral and openably and closably provided via a hinge or the like as another embodiment.

Although the coupling is entirely accommodated in the recess in the case of the above embodiment, a coupling may have a part partially protruding from the recess as another embodiment.

Although each wire is entirely accommodated in the wire-side recess in the case of the above embodiment, each wire may include a part partially protruding from the wire-side recess as another embodiment.

Although the body cover is arranged on the lower side of the cover member and the lid cover is arranged on the upper side of the cover member in the case of the above embodiment, a body cover may be arranged on an upper side of a cover member and a lid cover may be arranged on a lower side of the cover member as another embodiment. Further, a body cover and a lid cover may be respectively arranged on both left and right sides of a cover member. The mutual arrangement of the body cover and the lid cover in the cover member can be changed according to an installed state and the like.

LIST OF REFERENCE SIGNS

10—connector housing
11—body cover
12—lid cover
13—tightening member
14—corrugated tube
15—housing body
16—fitting tube
17—cavity
18—lock arm
19—seal ring
20—housing mounting portion
21—tube mounting portion
22—fastened portion
23—bottom wall
24—front wall
25—one side wall
26—other side wall
27—column
28—body lock
29—ridge
30—groove
31—insertion hole
32—creepage
33—surface
34—recess
35—wire-side recess
36—partition
37—first part
38—second part
39—third part
40—fourth part
41—supporting surface
42—receiving surface
43—inner corner
44—housing cover
45—tube cover
46—ceiling wall
47—front end wall
48—one side end wall
49—other side end wall
50—positioning projection
51—lid lock
52—engaging portion
53—guide surface
54—straight surface
55—insertion space
56—opening
57—projecting piece
58—recess
59—coupling
60—round corner on lower-inner side
62—pressing portion
63—pressed portion
64—base
65—band
66—locking hole
67—locking projection
68—locking tooth
69—wire fixing portion
70—top part
90—wire
VL—visual straight line

What is claimed is:

1. A connector, comprising:

a connector housing and a wire pulled out from the connector housing;

a body cover and a lid cover for covering the wire;

a tightening member to be wound along a surface of the body cover;

a first part and a second part provided on the surface of the body cover while being spaced apart in a circumferential direction;

a recess between the first and second parts in the body cover;

a pressing portion stretched from the first part toward the second part in the tightening member;

a coupling to be received into the recess in the lid cover; and a pressed portion arranged outwardly of a virtual straight line connecting the first and second parts in the coupling, the pressed portion being pressed toward an inner surface of the recess by the pressing portion.

2. The connector of claim 1, wherein the first part is arranged at a position higher than the pressed portion and the pressing portion is arranged obliquely down from the first part to the pressed portion when the first part is facing upward.

3. The connector of claim 2, wherein:

the recess has a supporting surface for supporting the coupling, a receiving surface facing one side surface of the coupling and an inner corner located at an intersection of the supporting surface and the receiving surface, and the pressed portion is arranged at a position diagonal to the inner corner.

4. The connector of claim 3, wherein:

the surface of the body cover includes a third part and a fourth part provided while being spaced apart in the circumferential direction, the body cover includes a wire-side recess for receiving the wire between the third and fourth parts, and the tightening member includes a wire fixing portion stretched from the first part to the fourth part, the wire fixing portion pressing the wire toward an inner surface of the wire-side recess.

* * * * *